United States Patent [19]

Powell

[11] Patent Number: 4,869,553

[45] Date of Patent: Sep. 26, 1989

[54] COLLAPSIBLE CHAIR FORMED FROM SHEET MATERIAL

[76] Inventor: Robert A. Powell, 3570 "I" St., #1, Sacramento, Calif. 95816

[21] Appl. No.: 268,848

[22] Filed: Nov. 9, 1988

[51] Int. Cl.[4] ..... A47C 1/14

[52] U.S. Cl. ..... 297/377; 5/419; 297/457

[58] Field of Search ..... 297/377, 382, 439, 454, 297/457; 5/417, 419, 420, 432–434

[56] References Cited

U.S. PATENT DOCUMENTS

| | | | |
|---|---|---|---|
| 1,659,093 | 2/1928 | Gaskin | 297/377 |
| 1,660,494 | 2/1928 | Robertson | 277/377 |
| 2,390,660 | 12/1945 | Muenzen | 5/433 X |
| 3,041,637 | 7/1962 | Emery | 5/433 |
| 3,312,503 | 4/1967 | Suzuki | 277/457 X |
| 3,627,086 | 12/1971 | Caigan | 297/192 X |
| 4,654,907 | 4/1987 | Haugaard | 297/377 X |

FOREIGN PATENT DOCUMENTS

| | | | |
|---|---|---|---|
| 412222 | 11/1966 | Switzerland | 297/377 |

*Primary Examiner*—Peter R. Brown

*Attorney, Agent, or Firm*—Thomas R. Lampe; Glen R. Grunewald

[57] ABSTRACT

A collapsible chair formed from sheet material including a seat panel, a back panel foldably connected to the seat panel, a reinforcement panel in registry with a portion of the back panel, a support panel foldably attached to the reinforcement panel, and projections extending from the back and support panels insertable in the ground to maintain the chair in set-up condition.

10 Claims, 2 Drawing Sheets

COLLAPSIBLE CHAIR FORMED FROM SHEET MATERIAL

TECHNICAL FIELD

This invention relates to a collapsible chair formed from sheet material. More particularly, the preferred form of chair constructed in accordance with the teachings of the present invention is formed from a unitary blank of corrugated paperboard or the like.

BACKGROUND ART

A wide variety of chair constructions are known in the art. In relatively recent times chairs constructed of inexpensive material such as corrugated paperboard have been devised. Such constructions are often characterized by their relative complexity and high cost. Also, many prior art chair constructions are difficult to assemble and disassemble.

In contrast, the chair of the present invention is of simple, inexpensive construction. Furthermore, the user may readily and quickly set-up the chair for use. Collapse or disassembly of the chair may also be carried out expeditiously. Although it may be used virtually anywhere, the chair of the present invention particularly lends itself to use at the beach or in other environments where soft ground or floor conditions exist. The chair will remain stable in set-up condition even when employed on sand, loose soil, turf, or carpet.

DISCLOSURE OF THE INVENTION

The collapsible chair of the present invention includes a seat panel having an outer surface and adapted to be positioned on the ground. The seat panel terminates at one end thereof along a first fold line.

A back panel is foldably connected to the seat panel along the first fold line, said back panel having an outer surface and being adapted to be positioned relative to the seat panel whereby the back panel extends upwardly from the seat panel and the outer surfaces of the back panel and seat panel define an obtuse angle.

A reinforcement panel is connected to the back panel along a second fold line spaced from the first fold line. The reinforcement panel is in registry with a portion of the back panel and extends from the second fold line to a third fold line.

A double-ended support panel is attached to the reinforcement panel at one of the ends thereof along the third fold line, with the other end of the support panel engageable with the ground.

At least one projection is integrally attached to the back panel and extends downwardly therefrom beyond the first fold line when the back panel extends upwardly from the seat panel whereby said at least one first projection is positionable in the ground. At least one second projection is integrally attached to the support panel and extends therefrom for positioning in the ground.

Other features, advantages, and objects of the present invention will become apparent with reference to the following detailed description and accompanied drawings.

DISCLOSURE OF THE INVENTION

Figure 1:
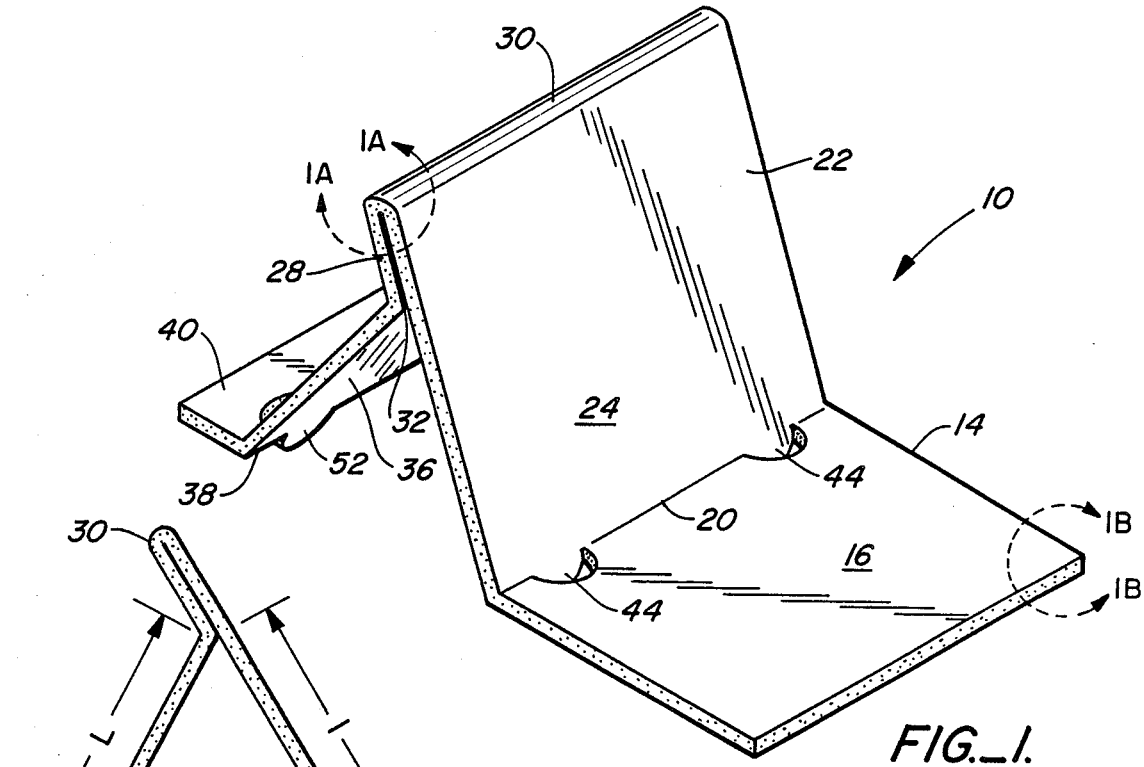
FIG. 1 is a perspective view of a chair constructed in accordance with the present invention.

A collapsible chair constructed in accordance with the present invention is shown in FIGS. 1, 1A, 1B, and 3 and is generally designated by reference number 10. Chair 10 is constructed from a unitary blank of sheet material, said blank being illustrated in FIG. 2 and designated by reference numeral 12. A suitable sheet material is double wall corrugated paperboard material. The collapsible chair 10 includes a seat panel 14 having an outer surface 16. The seat panel is adapted to be positioned on the ground with the user sitting on outer surface 16 thereof.

Figure 3:
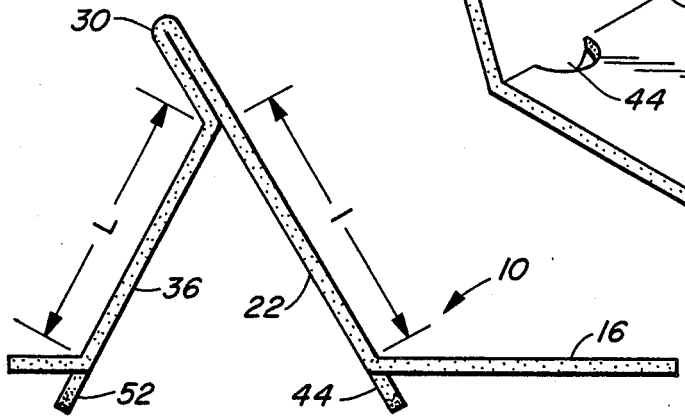
FIG. 3 is a side view of the chair of FIG. 1.
Figure 2:
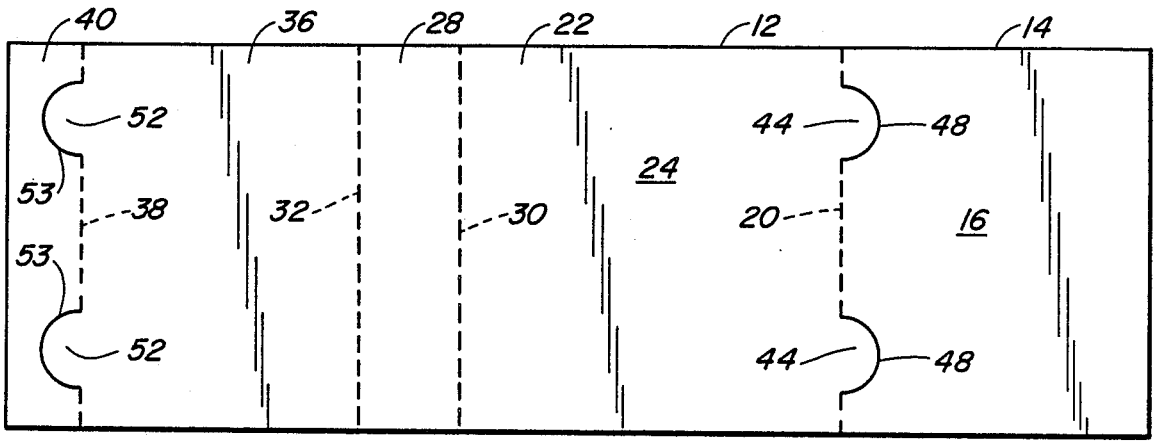
FIG. 2 is a plan view of a blank used to construct the chair of FIG. 1.
Figure 1A:
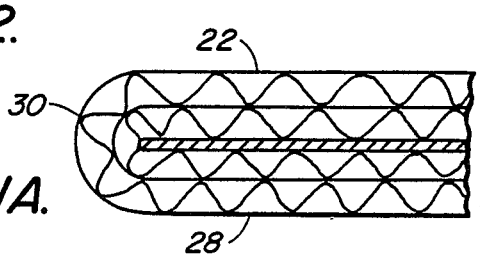
FIGS. 1A and 1B are enlarged sectional views taken along the lines 1A—1A and 1B—1B in FIG. 1.
Figure 1B:
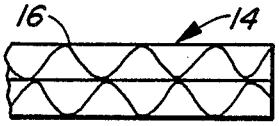

At one end thereof the seat panel 14 is defined by a first fold line 20. A back panel 22 is foldably connected to the seat panel along first fold line 20. The back panel 22 has an outer surface 24. When set-up, as shown in FIGS. 1 and 3, the back panel extends upwardly from the seat panel 14 and back panel outer surface 24 and seat panel outer surface 16 define an obtuse angle which provides a comfortable seating arrangement for the user. As will be seen, the angle may be readily varied by the user.

A reinforcement panel 28 is connected to the back panel 22 along a second fold line 30. The reinforcement panel is in registry with a portion of the back panel and extends from the second fold line 30 to a third fold line 32.

A double-ended support panel 36 is attached to the reinforcement panel 28 at one of the ends thereof along third fold line 32. The other end of support panel 36 is engageable with the ground when the chair 10 is in set-up condition. A fourth fold line 38 is located at the ground-engaging end of support panel 36. An end panel 40 is foldably connected to the support panel 36 at such location. As may readily be seen, the end panel 40 is adapted for positioning on the ground when the chair is set-up thereon.

Chair 10 includes a pair of first projections 44 integral with back panel 22. As may clearly be seen, the projections have a generally semi-circular configuration and each of the first projections is defined by a line of cut 48 formed in seat panel 14 and communicating with first fold line 20. First projections 44 extend downwardly from the back panel beyond the first fold line when the back panel extends upwardly from the seat panel, i.e. when the chair is in set-up condition. The first projections 44 are positionable in the ground and assist in stabilizing and maintaining the position of the chair relative to the ground.

Second projections 52 are integral with the support panel 36 and extend beyond fourth fold line 38. Second projections 52 are each formed by lines of cut 53 formed in said end panel 40 and communicating with fourth fold line 38. When the chair 10 is set-up on the ground and the end panel 40 positioned thereon, second projections 52 project into the ground and prevent movement of support panel 36 relative thereto. In other words, the first projections 44 and the second projections 52 cooperate to maintain the generally inverted V-shaped configuration defined by back panel 22 and support panel 36 when the chair 10 is being utilized. On the other hand, the precise angular relationship between the back panel 22 and the support panel 36 may be readily modified by pulling at least one pair of the projections out of the ground and repositioning same.

Figure 4:
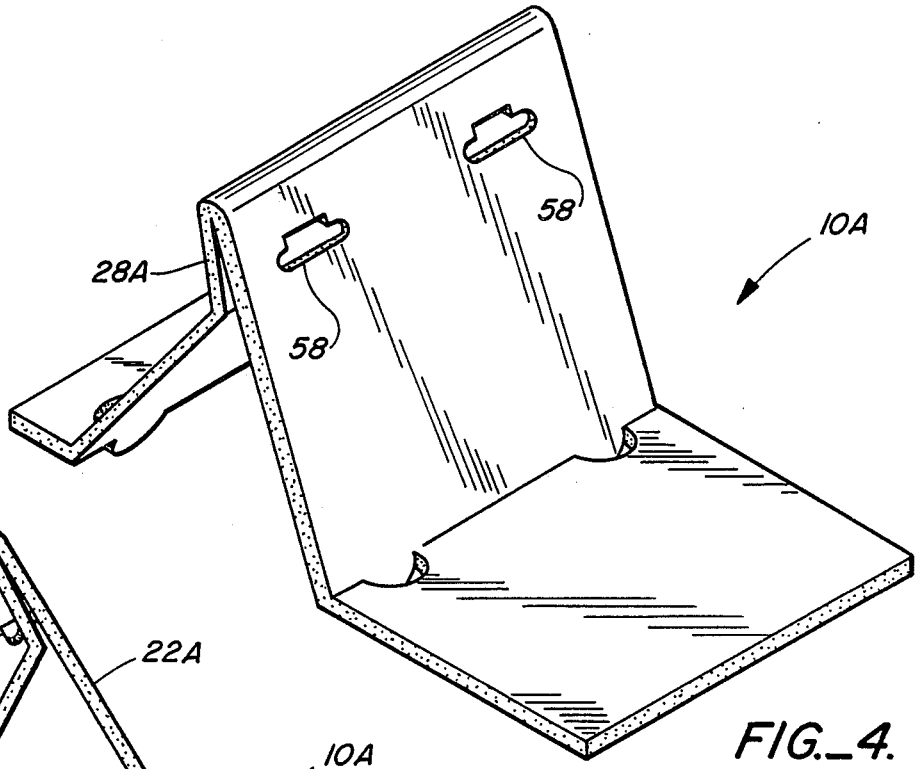
FIG. 4 is a perspective view of an alternative form of chair constructed in accordance with the present invention.
Figure 5:
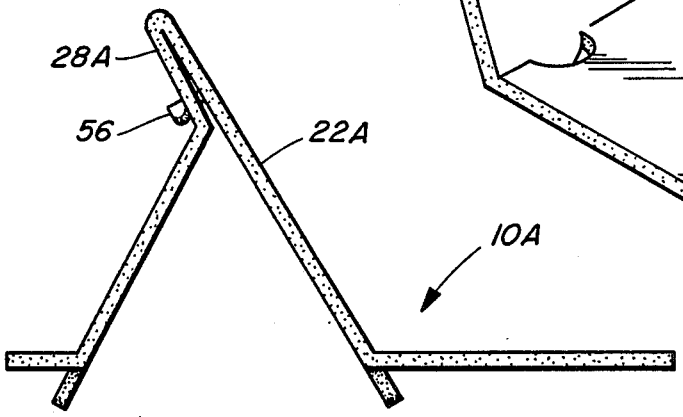
FIG. 5 is a side view of the chair of FIG. 4.
Figure 6:
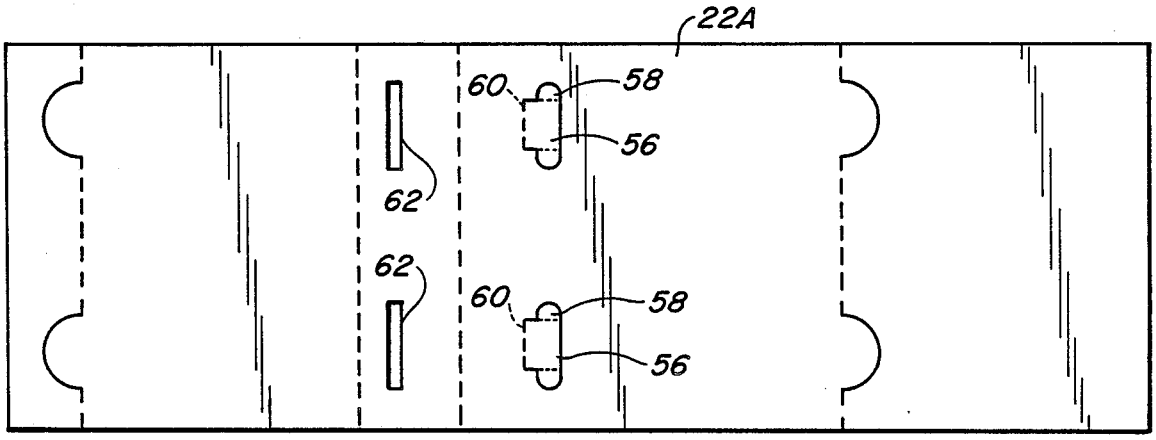
FIG. 6 is a plan view of a blank used to construct the chair of FIG. 4.

In the arrangement just described, the reinforcement panel 28 is permanently secured in face-to-face relationship with a portion of the back panel 22 by securing means in the form of adhesive. FIGS. 4–6 illustrate an alternative chair 10A wherein the reinfircement panel and back panel portion are releaseably secured together. More particularly, instead of adhesive, the locking means includes two spaced locking tabs 56 formed in back panel 22A along lines of cut 58. When the chair 10A is assembled, the locking tabs 56 are bent along score lines 60 and inserted into apertures 62 defined by the reinforcement panel 28A. The ends of the locking tabs may be bent to releasably maintain the locking tabs within the apertures.

The reinforcement panel performs a significant function insofar as strength and stability of the chair is concerned, whether the reinforcement panel is permanently secured to the back panel portion or releasably secured thereto. Referring to FIG. 3 once again, it will be seen that support panel 36 has a length L which is considerably less than the length it would have if the support panel were attached directly to the upper end of back panel 22. This is because the reinforcement panel reduces the L/t ratio of support panel 36 ("t" being the thickness of the paperboard material). This reduces flexure in support panel 36 and enables a material of less thickness than would otherwise be the case to be utilized to provide support for imposed axial loads on support panel 36.

Also, the reinforcement panel enables the span "1" of back panel 22 to be reduced. The bending moment is also therefore reduced. The back panel 22 acts as a beam and is subjected to bending when supporting superimposed load. The moment (in foot-pounds or inch-pounds) is determined by the formula $M=w1^2/8$, "w" equaling pounds per foot. Thus the moment is a function of the square of the span "1" (a geometric ratio). Bending moment determines section modulus as follows: $S=M/f$, where "f" equals fiber stress in bending. Therefore, reducing the span "1" reduces the required section modulus; hence material thickness required to resist the bending is reduced-all in geometric proportions.

Finally, the employment reinforcement panel 28 reduces the "overturning moment" of the chair. That is, the chair is less likely to collapse when subjected to imposed load. All of the above, of course, have the cumulative effect of enabling the chair to be made of less thick sheet material then would otherwise be the case. Manufacturing costs are therefore reduced.

I claim:

1. A collapsible chair formed from a unitary sheet of corrugated material having a generally uniform width and side edges, said chair comprising, in combination:

a seat panel having an outer surface, said seat panel adapted to be positioned on the ground and terminating at one end thereof along a first fold line formed in said sheet of corrugated material;

a back panel foldably connected to said seat panel along said first fold line, said back panel having an outer surface and being adapted to be positioned relative to said seat panel whereby said back panel extends upwardly from said seat panel and said back panel outer surface and said seat panel outer surface define an obtuse angle;

a rectangular-shaped reinforcement panel connected to said back panel along a second fold line formed in said sheet of corrugated material spaced from and parallel to said first fold line, said reinforcement panel being in registry with a portion of said back panel and extending from said second fold line to a third parallel fold line formed in said sheet of corrugated material and between said side edges; and a double-ended support panel, said support panel attached to said reinforcement panel at one of the ends thereof along said third fold line formed in said sheet of corrugated material, with the other end of said support panel engageable with the ground.

2. The collapsible chair according to claim 1 additionally comprising at least one first projection integrally attached to said back panel and extending downwardly therefrom beyond said first fold line when said back panel extends upwardly from said seat panel whereby said at least one first projection is positionable in said ground.

3. The collapsible chair according to claim 1 additionally comprising securing means for securing said reinforcement panel in registry with said back panel portion.

4. The collapsible chair according to claim 3 wherein said securing means comprises adhesive disposed between said reinforcement panel and said back panel portion and wherein said reinforcement panel and said back panel portion are in face-to-face engagement.

5. The collapsible chair according to claim 3 wherein said securing means comprises locking means for releasably securing together said reinforcement panel and back panel portion.

6. The collapsible chair according to claim 5 wherein said locking means includes at least one locking tab extending between said reinforcement panel and said back panel portion and positionable in an aperture defined by one of said reinforcement panel or back panel portion.

7. A collapsible chair formed from sheet material, said chair comprising, in combination:

a seat panel having an outer surface, said seat panel adapted to be positioned on the ground and terminating at one end thereof along a first fold line;

a back panel foldably connected to said seat panel along said first fold line, said back panel having an outer surface and being adapted to be positioned relative to said seat panel whereby said back panel extends upwardly from said seat panel and said back panel outer surface and said seat panel outer surface define an obtuse angle;

a reinforcement panel connected to said back panel along a second fold line spaced from said first fold line, said reinforcement panel being in registry with a portion of said back panel and extending from said second fold line to a third fold line;

a double-ended support panel, said support panel attached to said reinforcement panel at one of the ends thereof along said third fold line, with the other end of said support panel engageable with the ground; and an end panel foldably connected to said support panel along a fourth fold line spaced from said third fold line, said end panel adapted for positioning on said ground.

8. The collapsible chair according to claim 7 additionally comprising at least one second projection integrally attached to said support panel and extending from said other support panel end beyond said fourth fold line when said end panel is positioned on said ground.

9. The collapsible chair according to claim 8 wherein said at least one second projection is a cut-out portion formed in said end panel communicating with said fourth fold line.

10. A collapsible chair formed from sheet material, said chair comprising, in combination:

a seat panel having an outer surface, said seat panel adapted to be positioned on the ground and terminating at one end thereof along a first fold line;

a back panel foldably connected to said seat panel along said first fold line, said back panel having an outer surface and being adapted to be positioned relative to said seat panel whereby said back panel extends upwardly from said seat panel and said back panel outer surface and said seat panel outer surface define an obtuse angle;

a reinforcement panel connected to said back panel along a second fold line spaced from said first fold line, said reinforcement panel being in registry with a portion of said back panel and extending from said second fold line to a third fold line;

a double-ended support panel, said support panel attached to said reinforcement panel at one of the ends thereof along said third fold line, with the other end of said support panel engageable with the ground; and at least one first projection integrally attached to said back panel and extending downwardly therefrom beyond said first fold line when said back panel extends upwardly from said seat panel whereby said at least one first projection is positionable in said ground, said at least one first projection being a cut-out portion formed in said seat panel and communicating with said first fold line.

* * * * *